US005551112A

United States Patent [19]

Brandsma et al.

[11] Patent Number: 5,551,112

[45] Date of Patent: Sep. 3, 1996

[54] SHOE SUPPORT WITH PIVOTABLE CARRIER FOR USE WITH SEWING MACHINES

[75] Inventors: William J. Brandsma, Rifle; Eligio Ruybal, Greeley, both of Colo.

[73] Assignee: Shoes By Design, Inc., Rifle, Colo.

[21] Appl. No.: 234,865

[22] Filed: Apr. 28, 1994

[51] Int. Cl.[6] ..... A43D 3/00; D05C 7/04; D05B 3/12

[52] U.S. Cl. ..... 12/123; 112/103; 112/104

[58] Field of Search ..... 12/123, 124, 122; 112/103, 104; 280/623, 626; 294/162

[56] References Cited

U.S. PATENT DOCUMENTS

| | | | |
|---|---|---|---|
| 1,686,133 | 10/1928 | Hill | 12/123 |
| 3,126,853 | 3/1964 | Maves . | |
| 3,537,119 | 11/1970 | Hussey . | |
| 4,113,159 | 9/1978 | Allsop | 294/162 |
| 4,199,880 | 4/1980 | Frey | 36/7.5 X |
| 4,375,787 | 3/1983 | Brutti | 112/28 |
| 4,642,924 | 2/1987 | Sudderth et al. | 112/103 X |
| 4,831,753 | 5/1989 | Inteso | 112/103 X |

FOREIGN PATENT DOCUMENTS

| | | | |
|---|---|---|---|
| 41688 | 11/1887 | Germany | 12/123 |

*Primary Examiner*—B. Dayoan
*Attorney, Agent, or Firm*—Kyle W. Rost

[57] ABSTRACT

A shoe hoop, adapted for use in combination with a sewing machine, provides a rigid frame mountable in a fixed position with respect to an associated sewing machine. A sole plate carried within the frame has spring-loaded clamps that hold a shoe firmly to the plate. Pivot mechanisms position the sole plate at various angular dispositions within the frame and permit depth adjustment of the sole plate.

11 Claims, 4 Drawing Sheets

SHOE SUPPORT WITH PIVOTABLE CARRIER FOR USE WITH SEWING MACHINES

TECHNICAL FIELD

The invention generally relates to sewing, especially to leather sewing and to back gauges, rests, guards, and clamps used for sewing shoes. Another aspect of the invention relates to tools for boot and shoe making, especially to an expansible holder or work support. A hoop or jig supports a previously assembled athletic shoe in a variable position to enable embroidery to be added to one or more panels of the shoe structure.

BACKGROUND ART

Athletic shoes sometimes carry sewn designs, such as the manufacturer's logo, top stitching, or variously colored patches of leather or plastic. Substantially all such decoration is applied during manufacture, when individual panels of the shoe assembly can be independently sewn upon. However, once the shoe is assembled, sewing on a new design, such as by embroidery, is very difficult. In part, this difficulty arises because the completed shoe is thick-walled and stiff, often having multiple layers of leather, plastic, padding and lining. Heavy duty sewing equipment is required do a good job of sewing through such materials.

A further and related difficulty is that a completed shoe offers limited access to its interior, to the area where parts of the sewing machine must reach during post-assembly sewing. Thus, it is difficult to gain adequate access to permit sewing a design after the shoe is assembled. Adding to the problem, many athletic shoes are manufactured with seams, colored patches, and decorative panels, which are disposed at varied angles and curves on the shoe body. When a design is added to the shoe, the best arrangement is to follow a pre-existing patch, panel, or seam. However, gaining access to follow an oddly angled feature clearly presents a greater difficulty.

Several patents disclose machinery that is adapted for use in shoe making, although none appears suited for applying post-manufacture designs. For example, U.S. Pat. No. 3,126,853 to Maves teaches a support for a shoe that enables a commercial sewing machine to apply ornamental stitching to shoe leather before final assembly. Thus, this patent does not address the problems of applying post-manufacture decoration.

Another example is found in U.S. Pat. No. 4,375,787 to Brutti, which is directed to a shoe holding jig for securing the shoe while the uppers are stitched. The scope of this patent is limited to a mechanism for stitching a moccasin.

U.S. Pat. No. 3,537,119 to Hussey discloses a clamp that holds a shoe around the edges of the sole, to permit hand-sewing. The clamp is mounted on pivot brackets, allowing the clamp to be shifted in two planes. However, this patent does not teach how this arrangement could be adapted to work in combination with a sewing machine.

It would be desirable to create a device capable of positioning a premanufactured athletic shoe for subsequent addition of embroidered designs. In particular, it would be desirable to position such a shoe at whatever angle might be required so that the added design can follow the pre-existing patterns on the shoe. Because athletic shoes tend to have thick, stiff uppers, such a positioning device must be capable of operating in combination with a sewing machine, such as an industrial type of sewing machine which is capable of working on heavy materials.

To achieve the foregoing and other objects and in accordance with the purpose of the present invention, as embodied and broadly described herein, the shoe hoop or shoe support of this invention may comprise the following.

DISCLOSURE OF INVENTION

Against the described background, it is therefore a general object of the invention to provide a shoe support for positioning an athletic shoe with respect to the head of a sewing machine, to provide access to the shoe upper along any pre-existing pattern line.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, a shoe support, for use in combination with a sewing machine, provides a frame that, in use, is mountable in a fixed position with respect to an associated sewing machine. A carrying device holds a shoe with respect to the frame. Finally, a positioning device is capable of varying the position of the carrying device with respect to the frame.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

Figure 1:
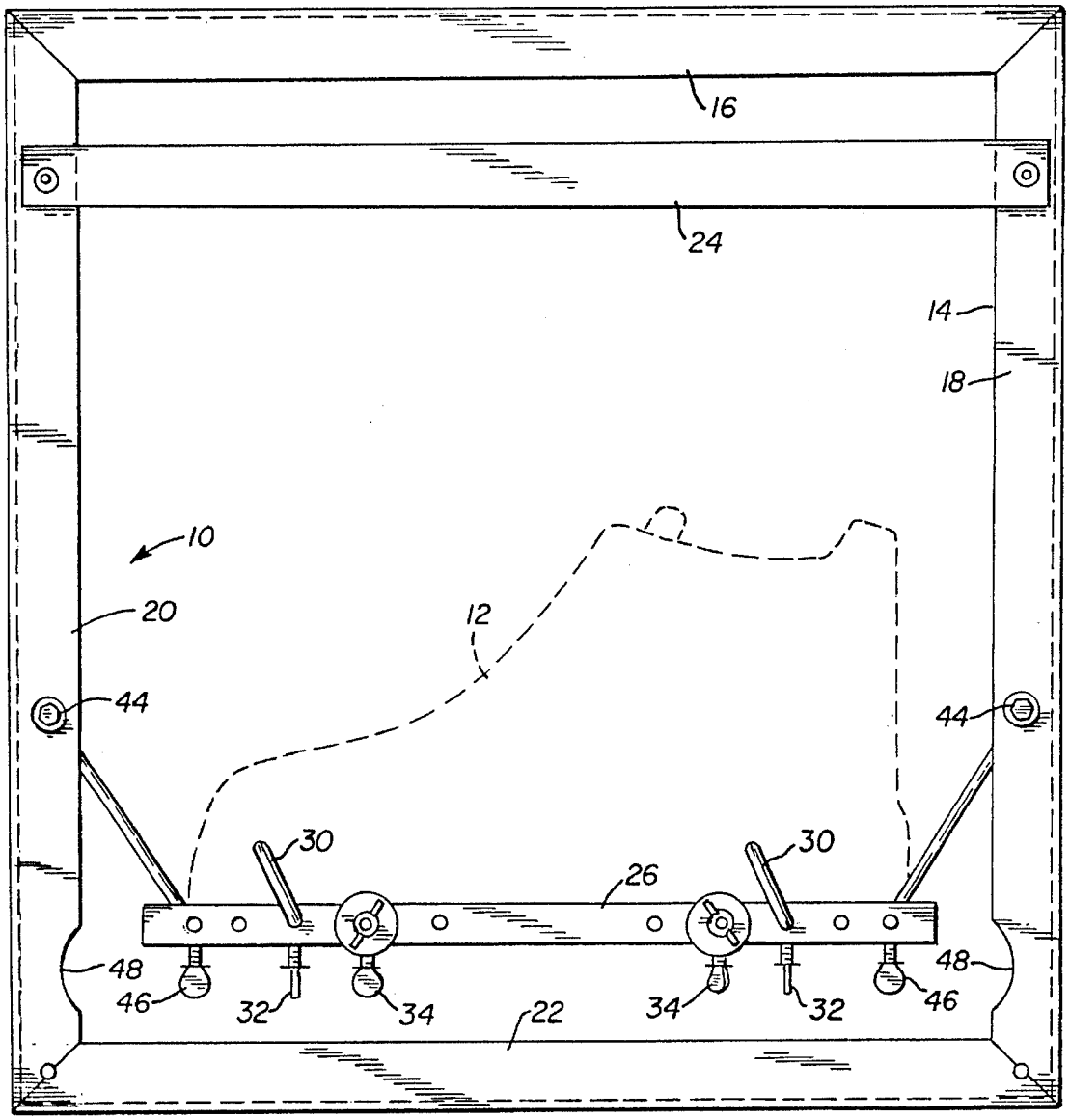
FIG. 1 is a bottom plan view of a shoe support, showing in phantom a shoe mounted therein.

As shown in FIG. 1, the invention is a shoe hoop or support 10 intended for use in cooperation with a sewing machine. The purpose of the shoe hoop 10 is to position a shoe 12 so that the sewing machine can embroider or otherwise sew a pattern on the upper of the shoe. In many cases, the shoe will have a pattern formed on its upper during original manufacture, and this pattern is likely to include seam lines, colored patches, or panels that are disposed at a variety of irregular angles on the upper. Accordingly, the shoe hoop 10 is adapted to position the shoe with respect to a sewing machine so that the sewing machine can apply the desired pattern to the shoe upper along a pre-existing seam line, panel, or patch.

The shoe hoop is bounded by a generally planar frame 14 about a central opening, which has the primary function of mounting the shoe hoop in a fixed position with respect to a sewing machine. In addition, the frame provides strength and rigidity to the shoe hoop, so that the carried shoe 12 is maintained in a stable position with a major plane of the shoe sole perpendicular to the central opening. While the shape of the frame and details of its construction are not critical, the preferred frame is in the shape of a rectangle, whose sides are formed of elongated right angle members, welded together at the corners. The frame members may be defined as a top bar 16, fight side bar 18, left side bar 20 and bottom bar 22. Typically, in use, the frame is disposed in a horizontal plane and, thus, the description that follows may refer to this typical orientation for purposes of example and not limitation.

Certain details of the frame construction are dependent upon the environment of its use. For example, the frame may attach to an industrial sewing machine or to a base, support table or other support structure for such a sewing machine. Typically, the top bar 16 will define attachment structures for fixing the frame to the machine or its support structure. Such attachment structures may include screw or stud mounting holes, keyholes, clips, or other fasteners. Additional supporting or fastening structures may be used as necessary. For example, in the embodiment of FIG. 1 the frame includes an optional support bar 24, parallel to and slightly spaced from top bar 16, for supporting the frame against a sewing machine table.

A carrying means, supported by the frame, serves to hold a shoe with respect to the frame. Any type of work support or clamp can serve this function, as long as it does not interfere with the operation of the sewing machine. The preferred type of carrying means is a sole plate equipped with a friction fastener, side clamp, toe clamp, heel clamp, magnetic holder, compression device, or the like, capable of engaging the shoe sole, the edges of the shoe sole, or the lower side or end portions of the shoe. A friction fastener includes any sort of holder that receives a portion of a shoe receptacle and retains the shoe by friction. A side clamp includes any sort of device that moves against, over, or under one or both sides of a shoe or the shoe sole to retain the shoe in the device. A toe clamp or heel clamp includes any sort of device that moves against, over or under the respective toe or heel of a shoe to retain the shoe in the device. A magnetic holder includes any sort of device that employs an electromagnet or permanent magnet to hold the shoe in the device, one example of which is the use of a ferrous insert in the shoe, coupled with an electromagnetic sole plate. A compression device is any sort of device that moves against any part of a shoe, thereby squeezing a part of the shoe and retaining the shoe in the device. These descriptions are given by way of example and not limitation.

Figure 2:
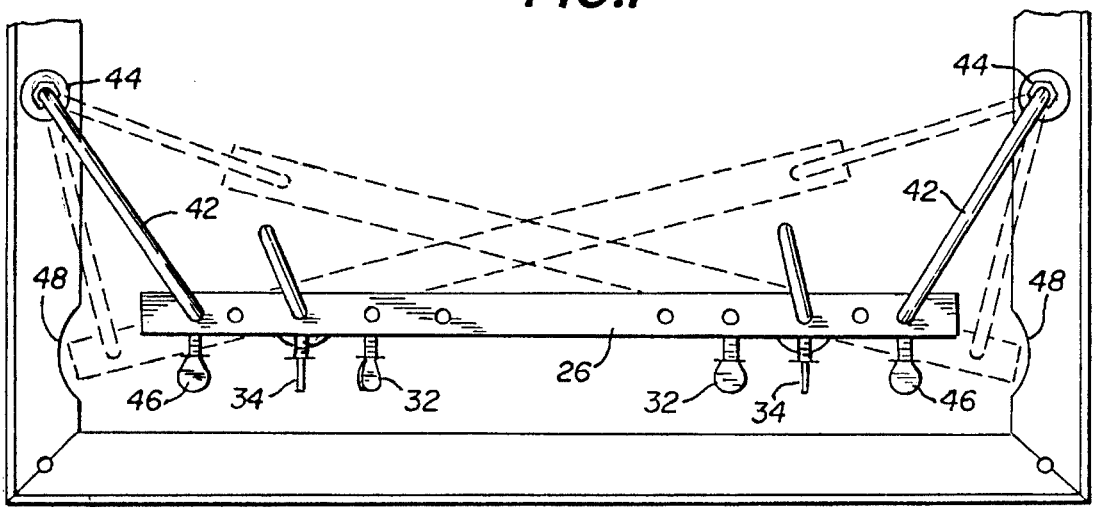
FIG. 2 is a fragmentary top plan view, showing the lower portion of the shoe support, with various positions of the shoe carder shown in phantom.
Figure 3:
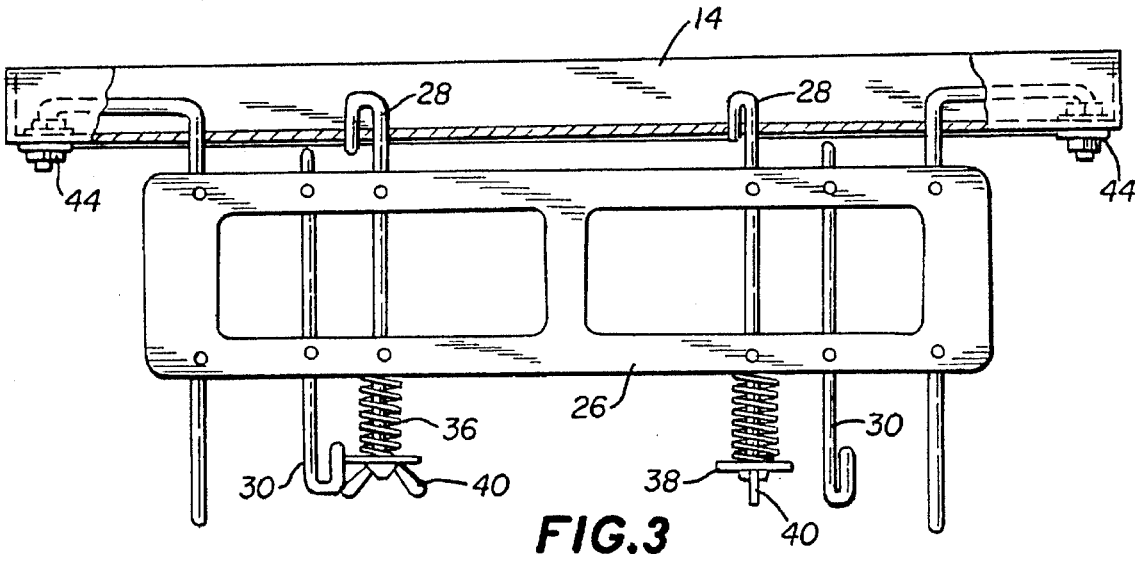
FIG. 3 is a front end view thereof.
Figure 4:
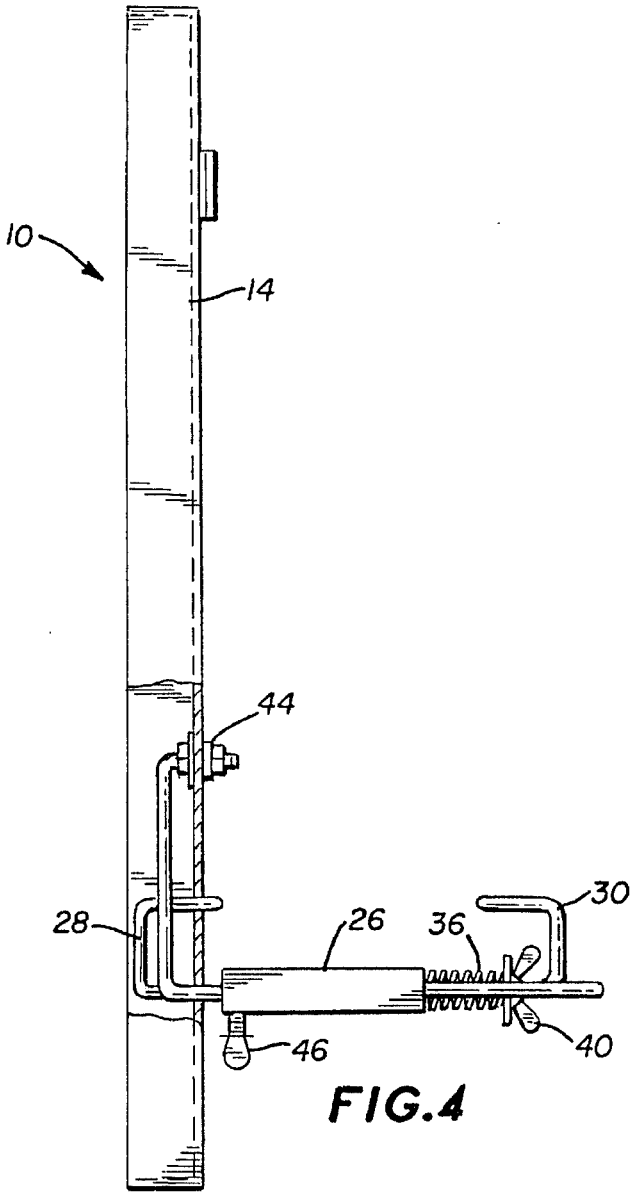
FIG. 4 is a side view thereof.

A preferred carrying means is the elongated sole plate 26 having a major surface perpendicular to the central opening of the frame shown in FIGS. 1 through 4. The plate itself is a support for the bottom of a shoe 12 during use of the shoe hoop and lies in a generally longitudinal position between the sides 18 and 20 of the frame. In addition, as best shown in FIGS. 3 and 4, the plate lies on one side of the plane of the frame and its major surface lies in a plane transverse to the plane of the frame. In typical use, the frame is disposed in a horizontal plane and the sole plate is carried below the frame.

The plate carries suitable clamping means or other mechanism for holding a shoe in fixed orientation with respect to the sole plate and for releasably attaching a shoe to the sole plate. In one preferred example, referring to FIG. 3, the clamping means is formed of first and second clamps, each defined by a pair of clamping arm members 28 and 30 carded by the sole plate. Each clamping arm member 28 or 30 has a shank passing through its own bore in the sole plate. One end of each shank forms a hook-shaped head. The second end of the shank is a tail piece extending from the edge of the sole plate opposite the hooked head. Each of the two arms 28 extend through the sole plate from side to side, with their hook-shaped heads on the same side of the plate, such as the upper side as viewed in FIG. 3. The other two arms 30 are similarly arranged, but with their hook-shaped heads on the opposite, lower side of the plate. One pair of the arms 28 and 30, i.e., a toe end pair, is located relatively nearer one longitudinal end of the sole plate and together define the first clamp. Another pair of the arms 28 and 30, i.e., a heel end pair, is located nearer the opposite longitudinal end of the sole plate and together define the second clamp. Primarily, the heel end and toe end designations are for convenience of reference and refer to the spaced apart positions of the two clamps along the longitudinal axis of the sole plate.

The first and second clamps adjust to accommodate substantially any shoe width. The head of arm 30 of each clamp typically forms the first portion or bottom portion of the clamp, or that portion furthest from frame 14 according to the orientation shown in FIG. 3. This arm is carried by the sole plate in a substantially fixed position with respect to the sole plate by a releasable fastener, such as by a thumb screw 32, FIGS. 1 and 2. The thumb screw is threaded into the sole plate and engages the shank of the arm, locking it in place in its bore. Thus, the thumb screw can be loosened to permit the shank to slide in the sole plate and be moved to adjust the width of the clamp, such as to raise or lower the position of the shoe on the sole plate. However, the arm is held in place by the thumb screw when the clamp is supporting a shoe and, in general, there is little need to move this clamp.

The head of arm 28 of each clamp typically forms the second or top portion of the clamp, and this second portion is carried by the sole plate for movement with respect to the sole plate, toward and away from first clamp portion 30. Optionally, arm 28 is held in a fixed position by a thumb screw 34 set against its shank. However, for speed and convenience of use, the head of arm 28 is preferred to be resiliently biased toward the first clamping member 30 by a resilient means such as a spring. For example, FIGS. 3 and 4 show that a compression spring 36 is telescoped over the tail piece of the shank, extending below the sole plate. This spring is contained by a washer 38 and wing nut 40 on one side, and by the sole plate on the other side. To insert or remove a shoe from the clamp, the clamp is opened by pulling the hooked head of arm 28 in the opposite direction from the hooked head of arm 30. Upon release, the spring-loaded hooked head of arm 28 moves by spring bias toward the hooked head of arm 30, automatically applying clamping pressure to a shoe located between the two hooked ends. Although the force of the resilient means biases the second clamping member toward the first clamping member with sufficient strength to clamp a shoe in place, thumb screw 34 can be used to secure the position of arm 28, if desired.

In addition to the width adjustments just described, the clamps also accommodate variations in shoe sole thickness. The hooked head of each arm 28, 30 has a mouth large enough to overlap the sole plate by a substantial margin. For example, the mouth of each hook might have an inch of clearance between the sole plate and the free end of the hook. This clearance can be reduced as much as desired by rotating the shank within the sole plate, bringing the free end of the hook closer to the surface of the sole plate. Thus, the free end of the hook can be brought against the side of a shoe or shoe sole at any desired height above the sole plate, limited only the by the size of the mouth.

When shoe 12 is mounted on the carrying means, such as on sole plate 26, a sewing machine can be used to embroider numbers, words, and designs on the shoe. Often the shoe will have seams, patches, and panels at various angles on the sides of the shoe upper. It is deskable that an embroidered design follow existing patterns on the shoe. Generally, a work piece carrier such as frame 14 is mounted in a single, fixed position with respect to a sewing machine. Therefore, in order to position the shoe 12 so that the sewing machine can follow patterns on the shoe, the shoe hoop includes a means for positioning the sole plate in the frame at any of various angles or locations. By way of example, in phantom FIG. 2 shows a range of angles and locations in which the sole plate can be positioned in the frame.

The multiple positions illustrated in FIG. 2 are achieved by moving the sole plate into predetermined positions with the assistance of first and second guiding means, which may include pivot mechanisms located at one or both longitudinal ends of the sole plate. In one preferred embodiment, these guiding means may be two similar pivot arms 42, attached from each end of the sole plate to opposite, respective nearest sides of the frame. These ends of the pivot arms may be referred to as the frame end and the sole plate end, and the central length of each and may be referred to as the shank. At the frame end, the tip of each pivot arm is bent 90° to a position approximately normal to the plane of the frame and forms a hinge pin operating on a single pivot axis. This end portion of each arm 42 may be mounted in a bushing 44 and be held in place by a suitable fastener, such as by a nut. Similarly, at the sole plate end each pivot arm is bent 90° to the shank, to a position approximately normal to the plane of the frame, and passes through a transverse bore in the sole plate. One or more fasteners, such as thumb screw 46, releasably secure the sole plate end in its bore, where it serves as a hinge pin operating on a single axis. Together, the two pivot arms 42 allow the sole plate to assume a variety of angular positions relative to the frame. As shown in FIGS. 1 and 2, the frame may have a notch or scallop 48 in its inside edges to permit the sole plate to have an increased range of motion.

The positioning means also may serve as depth adjusting means for positioning the carrying means at variably preselected distances from the plane of the frame. Thus, the pivot arms may serve the additional function of supporting the sole plate at various depths below the plane of the frame 14. To achieve this function, the pivot arms are provided with sole plate ends that are longer than the width of the sole plate itself and that extend for a distance beyond such width of the sole plate. Each of the long ends allow the sole plate to be variably positioned along its longitudinal axis and to be secured by a fastener 45. Thus, the sole plate can be positioned at variable depths below the plane of frame 14 on the long ends of the pivot arms, as may be required or convenient when any particular shoe is the current work piece.

Figure 5:
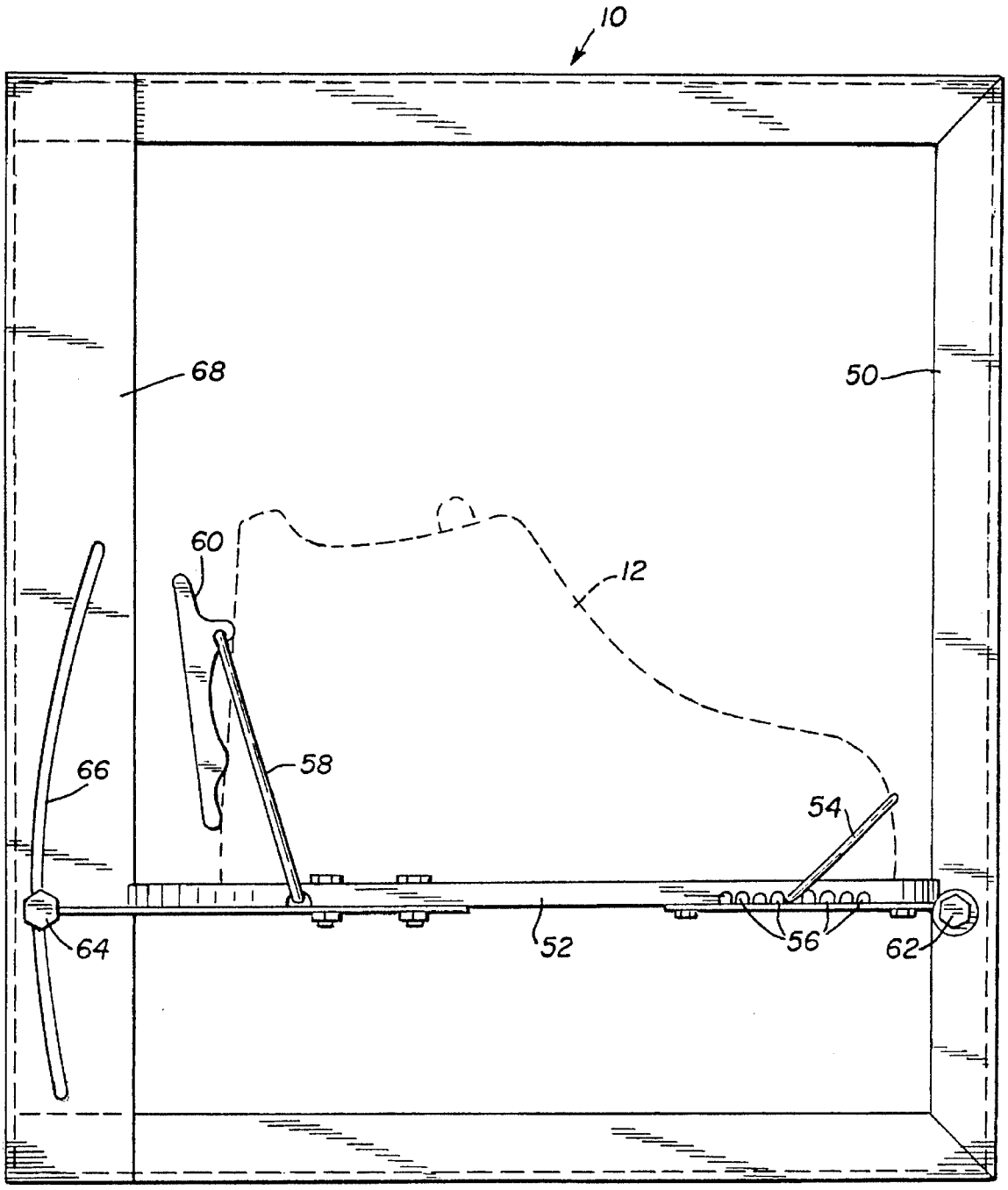
FIG. 5 is a bottom plan view similar to FIG. 1, showing an alternate embodiment thereof.
Figure 6:
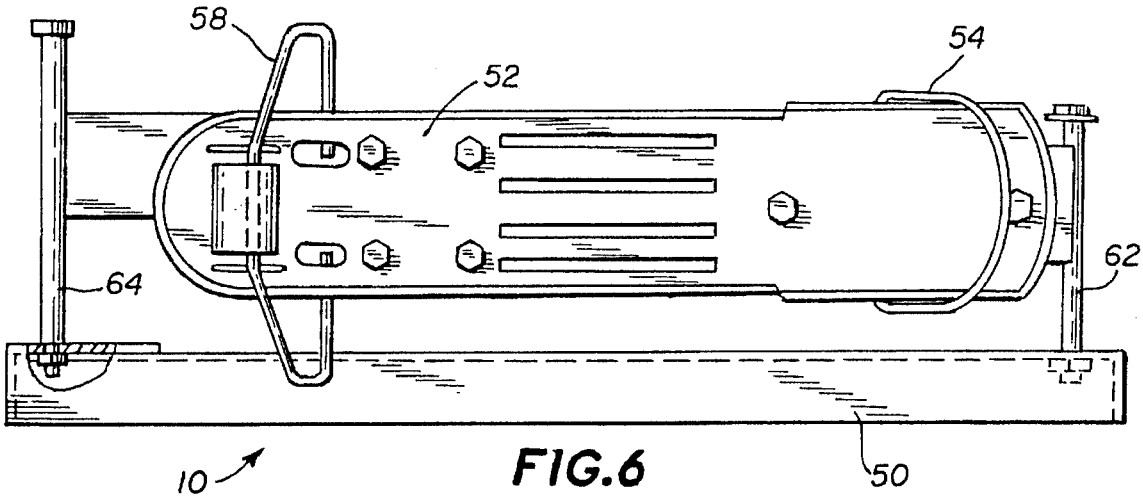
FIG. 6 is a front end view of the embodiment of FIG. 5.
Figure 7:
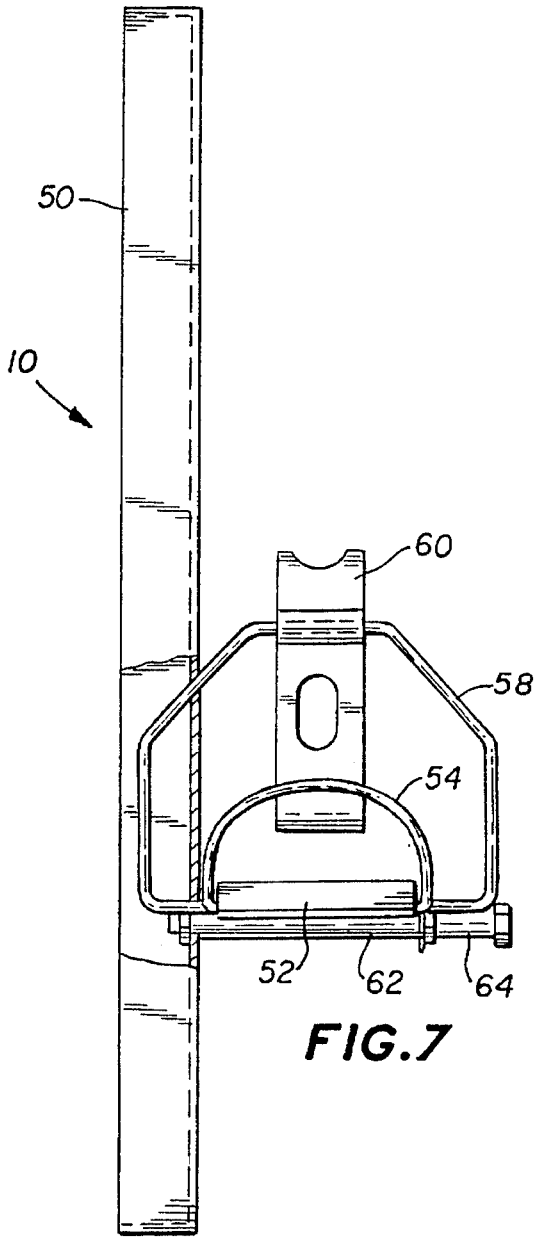
FIG. 7 is a side view of the embodiment of FIG. 5.

An alternative embodiment of the shoe hoop 10 is shown in FIGS. 5–7. A generally planar frame 50 provides a rigid base for mounting a shoe 12 and is constructed similarly to frame 14. The carrying means for the shoe in the frame is a sole plate 52, and the clamping means is a pair of bails, such as a toe clamp or bail and a heel clamp or bail, respectively located near opposite ends of the sole plate. The toe clamp is a first bail 54 that pivotally mounts to the sole plate in any of a series of transversely disposed holes 56, located in the side walls of the sole plate. The bail 54 can be transferred from hole to hole by spreading the ends of the bail to remove it from one hole, and then inserting the ends at another hole. The bail is preferred to be constructed of metal or another resilient material, so that the bail will permit repeated removals without losing its shape. The heel clamp 58 is a second ball, equipped with an over-center locking means such as lever 60 that pivots over a fulcrum to lock the shoe in place.

The positioning means in FIGS. 5–7 includes first and second guiding means that allows the shoe 12 to assume various angles with respect to the frame 50. The sole plate 52 is connected at a first longitudinal end to the frame 50 on a first guiding means, which may be, for example, a fixed toe pivot pin 62. Motion between the sole plate and frame at the toe pivot is about one point only, on the axis defined by pivot pin 62. The second longitudinal end of the sole plate, for example the heel end of the sole plate, is moveable with respect to the frame through an arc, defined by an arcuate slot 66 on a radius to pivot pin 62 and formed in a side plate 68 on the frame 50. The second guiding means includes a follower in slot 66, such as, for example, a locking pin 64 that passes through arcuate slot 66 and is disposed generally normally to the plane of frame 50. The illustrated position of the shoe places the shoe sole square with the frame and may be termed a neutral position. As best shown in FIG. 5, slot 66 permits the sole plate to be swung either up or down from neutral position.

In use, the shoe hoop provides a steady rest for an athletic shoe that is being decorated on its side wall. The frame can be firmly mounted to a sewing machine, and the shoe is firmly mounted within the frame. A sole plate works well in combination with suitable clamping means to hold an athletic shoe in a fixed position within the frame. The moveable or pivotable sole plate provides the desirable angle adjustment so that the sewing machine can follow a pre-existing pattern on the shoe. Quick insertion and removal of the shoe from the hoop is an advantage. Therefore, the clamping means can be further adapted to particular shoe structures, for speed and ease of use.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as failing within the scope of the invention as defined by the claims that follow.

We claim:

1. A shoe support for use in combination with a sowing machine, comprising:

a frame defining a perimeter about a central opening therein, having means for mounting the shoe support in a fixed position with respect to an associated sewing machine;

a carrying means for holding a shoe with respect to said frame, with a major plane of a shoe sole extending perpendicularly to the central opening of the frame; and a positioning means for varying the position of said carrying means with respect to the frame.

2. The shoe support of claim 1, wherein said carrying means comprises:

a sole plate connected to said frame and having a major surface perpendicular to the central opening of the frame; and a clamping means for, holding a shoe in a fixed orientation with respect to said sole plate, with a major plane of the shoe sole disposed parallel to said major surface.

3. The shoe support of claim 2, wherein said clamping means comprises: a first clamp, comprising first and second clamping members, carried by said sole plate;

wherein said first clamping member is carried by the sole plate in a substantially fixed position with respect to the sole plate; and said second clamping member is carried by the sole plate for movement with respect to the sole plate, toward and away from the first member; and a means for resiliently biasing the second clamping member toward the first clamping member for, in use, clamping a shoe between the first and second clamping members by the force of said resilient means.

4. The shoe support of claim 3, wherein:

said first clamp is connected to said sole plate near a first longitudinal end thereof; and wherein said clamping means further comprises a second clamp connected to the sole plate near a second longitudinal end thereof, opposite from said first longitudinal end.

5. The shoe support of claim 2, wherein said clamping means comprises: first and second bails, each located near an opposite longitudinal end of said sole plate;

wherein said first bail comprises a toe bail; and said second bail comprises a heel bail; and an over-center lock means carded by said heel bail for, in use, releasably securing the heel bail in engagement with a shoe.

6. The shoe support of claim 1, wherein said carrying means is longitudinally elongated and said positioning means comprises:

a first guiding means connecting a first longitudinal end of said carrying means to said frame for pivotal motion about at least one point; and a second guiding means connecting a second, opposite longitudinal end of the carrying means to the frame for motion through an arc.

7. The shoe support of claim 6, wherein said first guiding means comprises a first pivot and connected at a first end thereof to said carrying means and connected at a second end thereof to said frame; and wherein both ends of said first pivot arm comprise pivotal connections permitting motion about at least one axis.

8. The shoe support of claim 7, wherein said second guiding means comprises a second pivot arm connected at a first end thereof to said carrying means and connected at a second end thereof to said frame; and wherein both ends of said second pivot arm comprise pivotal connections permitting motion about at least one axis.

9. The shoe support of claim 6, wherein said frame lies generally along a plane and wherein said positioning means further comprises a depth adjusting means for positioning said carrying means at variable preselected distances from the plane of the frame.

10. The shoe support of claim 8, wherein said first and second guiding means each comprise a pivot arm having a central shank, said first end portion disposed at about 90° to the shank and passing through a bore in said carrying means, such that the first end portion is disposed approximately normal to the frame;

wherein said carrying means and first end portion are joined for relative movement along a longitudinal axis of said first end portion, such that the distance between the carrying means and the frame is selectively positionable by movement of the carrying means with respect to the length of the first end portion of the pivot arm.

11. The shoe support of claim 6, wherein:

said first guiding means comprises a pivot pin connected at a first end thereof to said carrying means and connected at a second end thereof to said frame, guiding the motion of the carrying means about an axis of the pin;

said frame defines an arcuate slot on a radius from said pivot pin and in a frame portion near the second end of the carrying means; and said second guiding means comprises a follower in said slot.

* * * * *